US010531702B2

(12) United States Patent
Cin et al.

(10) Patent No.: US 10,531,702 B2
(45) **Date of Patent: *Jan. 14, 2020**

(54) ARTICLE OF FOOTWEAR WITH INNER AND OUTER MIDSOLE LAYERS

(71) Applicant: NIKE, Inc., Beaverton, OR (US)

(72) Inventors: David Jonathan Cin, Portland, OR (US); Drew Conant, Lake Oswego, OR (US); Anthony P. Daversa, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 234 days.

This patent is subject to a terminal disclaimer.

(21) Appl. No.: 15/601,072

(22) Filed: May 22, 2017

(65) Prior Publication Data

US 2017/0251761 A1 Sep. 7, 2017

Related U.S. Application Data

(63) Continuation of application No. 14/601,318, filed on Jan. 21, 2015, now Pat. No. 9,693,604.
(Continued)

(51) Int. Cl.
*A43B 5/02* (2006.01)
*A43B 13/12* (2006.01)
(Continued)

(52) U.S. Cl.
CPC ..... *A43B 5/025* (2013.01); *A43B 13/122* (2013.01); *A43B 13/125* (2013.01); *A43B 13/14* (2013.01); *A43B 13/188* (2013.01)

(58) Field of Classification Search
CPC ..... A43B 13/186; A43B 13/187; A43B 13/42; A43B 13/04; A43B 13/12; A43B 13/125;
(Continued)

(56) References Cited

U.S. PATENT DOCUMENTS 2,104,133 A * 1/1938 Mees ..... A43B 13/141 36/3 B
2,365,203 A * 12/1944 Margolin ..... A43B 17/08 36/3 B
(Continued)

FOREIGN PATENT DOCUMENTS

EP 1728446 A1 12/2006

OTHER PUBLICATIONS

Extended European Search Report for European Application No. EP15798989.8, dated Dec. 8, 2017.

*Primary Examiner* — Jameson D Collier
*Assistant Examiner* — Heather N Mangine
(74) *Attorney, Agent, or Firm* — Quinn IP Law

(57) ABSTRACT

An article of footwear includes an outsole that has a bottom portion and a medial arch portion extending upward from the bottom portion. The medial arch portion of the outsole has a base and a plurality of protrusions extending outward from the base. The plurality of protrusions are arranged in vertical alignments. In each one of the vertical alignments, at least one protrusion of the plurality of protrusions is closer to the bottom portion and has a larger effective diameter than at least one other protrusion of the plurality of protrusions that is further from the bottom portion.

14 Claims, 12 Drawing Sheets

Related U.S. Application Data

(60) Provisional application No. 62/005,230, filed on May 30, 2014.

(51) Int. Cl.
*A43B 13/14* (2006.01)
*A43B 13/18* (2006.01)

(58) Field of Classification Search
CPC ..... A43B 13/127; A43B 13/38; A43B 13/16; A43B 13/14; A43B 13/188; A43B 17/003; A43B 17/14; A43B 17/18; A43B 17/10; A43B 17/08; A43B 5/025; A43B 5/002; A43B 5/003; A43B 5/005; A43B 23/0625
USPC ..... 36/103, 88, 102, 25 R, 43, 133, 91, 96, 36/59 R
See application file for complete search history.

(56) References Cited

U.S. PATENT DOCUMENTS 3,426,455 A * 2/1969 Drago ..... A43B 5/0417 36/3 B
3,769,723 A * 11/1973 Masterson ..... A43B 5/02 36/128
3,992,788 A * 11/1976 Orien ..... A43B 5/10 36/91
4,389,798 A * 6/1983 Tilles ..... A43B 5/00 36/129
4,524,531 A * 6/1985 Vanderipe ..... A43B 5/001 36/127
4,586,274 A * 5/1986 Blair ..... A43C 13/04 36/114
4,614,046 A * 9/1986 Dassler ..... A43B 5/06 36/30 R
4,759,136 A * 7/1988 Stewart ..... A43B 7/14 36/114
4,852,273 A * 8/1989 Hamy ..... A43B 7/141 36/28
4,897,937 A * 2/1990 Misevich ..... A43B 7/1425 36/140
4,910,882 A * 3/1990 Goller ..... A43B 17/00 36/141
4,947,560 A * 8/1990 Fuerst ..... A43B 5/00 36/114
5,131,173 A * 7/1992 Anderie ..... A43B 13/14 36/114
5,216,827 A * 6/1993 Cohen ..... A43B 5/02 36/114
5,367,791 A * 11/1994 Gross ..... A43B 13/181 36/25 R
5,586,398 A * 12/1996 Carlson ..... A43B 5/06 36/114
5,675,914 A * 10/1997 Cintron ..... A43B 17/08 36/29
5,799,413 A * 9/1998 Argyris ..... A43B 7/00 36/141
5,806,209 A * 9/1998 Crowley ..... A43B 13/18 36/28
6,000,148 A * 12/1999 Cretinon ..... A43B 5/00 36/69
6,061,929 A * 5/2000 Ritter ..... A43B 3/0052 36/107
6,357,145 B1 * 3/2002 James ..... A43B 1/0027 36/103
6,523,282 B1 * 2/2003 Johnston ..... A43B 5/02 36/133
6,763,616 B2 * 7/2004 Ellis ..... A43B 13/141 36/102
6,775,930 B2 * 8/2004 Fuerst ..... A43B 13/026 12/146 B
7,047,668 B2 * 5/2006 Burris ..... A43B 5/02 36/133
7,278,226 B2 * 10/2007 Holden ..... A43B 7/1425 36/103
7,730,640 B2 * 6/2010 Clark ..... A43B 7/125 36/113
8,458,928 B2 * 6/2013 Becker ..... A43B 13/026 36/102
2001/0027615 A1 * 10/2001 Nasako ..... A43B 13/125 36/28
2003/0019127 A1 * 1/2003 Parisotto ..... A43B 5/002 36/25 R
2003/0093920 A1 * 5/2003 Greene ..... A43B 7/141 36/25 R
2003/0226280 A1 * 12/2003 Paratore ..... A43B 7/12 36/4
2004/0154188 A1 * 8/2004 Laska ..... A43B 5/06 36/25 R
2004/0181971 A1 * 9/2004 Turkbas ..... A43B 7/141 36/44
2005/0188562 A1 * 9/2005 Clarke ..... A43B 5/18 36/15
2006/0059716 A1 * 3/2006 Yamashita ..... A43B 13/14 36/59 R
2006/0196084 A1 * 9/2006 Kos ..... A43B 1/0081 36/128
2007/0033834 A1 * 2/2007 Cheskin ..... A43B 7/141 36/44
2007/0227040 A1 * 10/2007 Kilgore ..... A43B 3/0063 36/25 R
2007/0240333 A1 * 10/2007 Le ..... A43B 5/08 36/30 R
2007/0256329 A1 * 11/2007 Antonelli ..... A43B 1/0009 36/68
2009/0025260 A1 * 1/2009 Nakano ..... A43B 13/141 36/25 R
2009/0100711 A1 * 4/2009 Engel ..... A43B 5/02 36/91
2009/0113757 A1 * 5/2009 Banik ..... A43B 7/144 36/28
2009/0119949 A1 * 5/2009 Song ..... A43B 13/146 36/103
2009/0293308 A1 * 12/2009 Bruce ..... A43B 7/14 36/88
2009/0300945 A1 * 12/2009 Droege ..... A43B 5/02 36/103
2010/0077637 A1 * 4/2010 Hatzilias ..... A43B 5/02 36/133
2010/0223817 A1 * 9/2010 Chang ..... A43B 3/0073 36/3 B
2010/0229424 A1 * 9/2010 Roberti ..... A43B 3/24 36/91
2010/0299967 A1 * 12/2010 Atsumi ..... A43B 5/02 36/133
2010/0307032 A1 * 12/2010 Geer ..... A43B 1/0072 36/25 R
2010/0331122 A1 * 12/2010 Morag ..... A43B 5/025 473/422
2011/0030245 A1 * 2/2011 Truelsen ..... A43B 5/06 36/30 R
2011/0072690 A1 * 3/2011 Teteriatnikov ..... A43B 13/145 36/30 R
2011/0197470 A1 * 8/2011 Caron ..... A43B 1/0072 36/29
2011/0225852 A1 * 9/2011 Mahoney ..... A43B 13/12 36/30 R
2011/0247240 A1 * 10/2011 Eder ..... A43B 1/0009 36/133
2011/0258879 A1 * 10/2011 Dananberg ..... A43B 7/141 36/91
2011/0258883 A1 * 10/2011 Eder ..... A43B 5/02 36/133
2011/0271553 A1 * 11/2011 McCarron ..... A43B 5/006 36/31
2011/0283561 A1 * 11/2011 Xie ..... A43B 7/14 36/43

(56) References Cited

U.S. PATENT DOCUMENTS

| | | | | |
|---|---|---|---|---|
| 2012/0073160 | A1* | 3/2012 | Marvin | A43B 13/186 36/28 |
| 2012/0144695 | A1* | 6/2012 | McDowell | A43B 13/122 36/28 |
| 2012/0167417 | A1* | 7/2012 | McDowell | A43B 7/085 36/107 |
| 2012/0198728 | A1* | 8/2012 | Farrelly | A43B 3/0063 36/25 R |
| 2012/0233888 | A1* | 9/2012 | Baker | A43B 5/025 36/133 |
| 2012/0297643 | A1* | 11/2012 | Shaffer | A43B 1/0027 36/83 |
| 2013/0074374 | A1* | 3/2013 | Droege | A43B 5/025 36/133 |
| 2013/0125421 | A1* | 5/2013 | Stegmaier | A43B 1/10 36/102 |
| 2013/0160328 | A1* | 6/2013 | Hatfield | A43B 23/02 36/103 |
| 2014/0150298 | A1* | 6/2014 | Crowley | A43B 7/1445 36/103 |
| 2014/0325876 | A1* | 11/2014 | Dodge | A43B 13/141 36/103 |
| 2015/0075036 | A1* | 3/2015 | Davis | A43B 7/081 36/25 R |
| 2016/0143395 | A1* | 5/2016 | Van Atta | A43B 5/025 36/48 |

* cited by examiner

ARTICLE OF FOOTWEAR WITH INNER AND OUTER MIDSOLE LAYERS

CROSS-REFERENCE TO RELATED APPLICATIONS

This application claims the benefit of priority to and is a continuation of U.S. patent application Ser. No. 14/601,318, filed Jan. 21, 2015, such prior U.S. Patent Application being entirely incorporated herein by reference. U.S. patent application Ser. No. 14/601,318 claims the benefit of priority to U.S. Provisional Application No. 62/005,230 filed May 30, 2014, such prior U.S. Provisional Application being entirely incorporated herein by reference.

TECHNICAL FIELD

The present disclosure relates to a sole assembly for an article of footwear.

BACKGROUND

Footwear typically includes a sole configured to be located under a wearer's foot to space the foot away from the ground or floor surface. Soles can be designed to provide a desired level of cushioning. Athletic footwear in particular sometimes utilizes polyurethane foam, rubber, or other resilient materials in the sole to provide cushioning.

DETAILED DESCRIPTION

Figure 1:
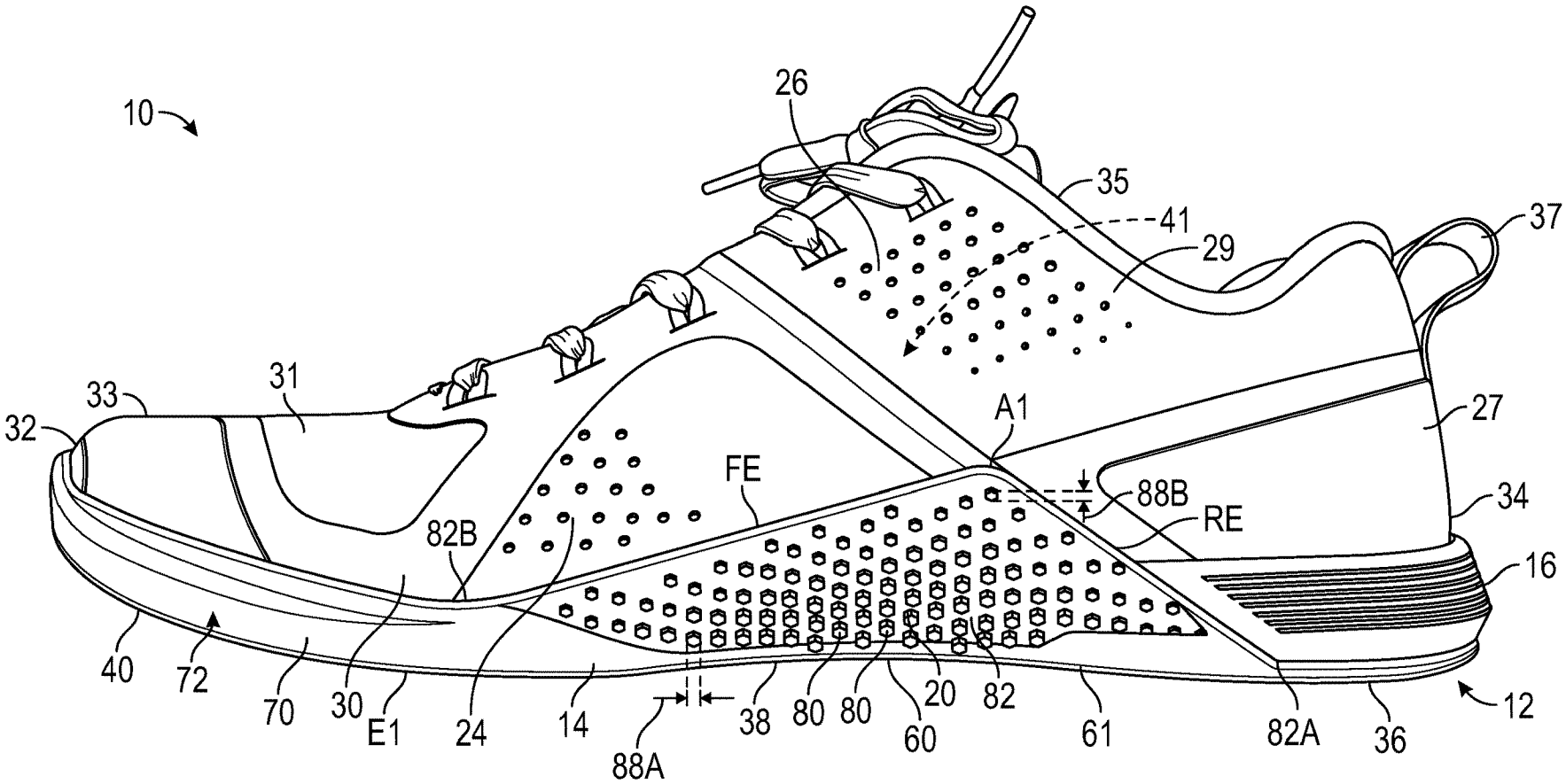
FIG. 1 is a schematic illustration in side view of a medial side of an article of footwear.

An article of footwear is disclosed that includes a variety of features making it suitable for use in different activities, including athletic activities, such as but not limited to running, rope climbing, and weightlifting. An article of footwear comprises an outsole that has a bottom portion and a medial arch portion extending upward from the bottom portion. The medial arch portion of the outsole has a base and a plurality of protrusions extending outward from the base. The plurality of protrusions are arranged in vertical alignments. In each one of the vertical alignments, at least one protrusion of the plurality of protrusions is closer to the bottom portion and has a larger effective diameter than at least one other protrusion of the plurality of protrusions that is further from the bottom portion.

In one or more embodiments, in each one of the vertical alignments, at least one protrusion of the plurality of protrusions closer to the bottom portion has a greater length than at least one other protrusion of the plurality of protrusions that is further from the bottom portion, with length of a protrusion measured along a center axis of the protrusion from the base to a distal end of the protrusion.

In one or more embodiments, the plurality of protrusions decrease in length in a direction away from the bottom portion. In one or more embodiments, the plurality of protrusions are of the same shape.

In one or more embodiments, the medial arch portion is generally triangular.

In one or more embodiments, the medial arch portion has a rear edge, a front edge, and an apex between the rear edge and the front edge. The rear edge angles forward from the bottom portion to the apex, and the front edge angles rearward from the bottom portion to the apex.

In one or more embodiments, the bottom portion has tread elements in the forefoot region, the midfoot region, and the heel region. At least some of the tread elements of the bottom portion and at least some of the plurality of protrusions may be of an identical shape.

In one or more embodiments, the outsole further comprises a lateral arch portion extending upward from the bottom portion. The lateral arch portion may have a base and a plurality of protrusions extending outward from the base. At least one of the plurality of protrusions extending outward from the base of the medial arch portion has a greater length than at least one of the plurality of protrusions extending outward from the base of the lateral arch portion, with length of a protrusion measured along a center axis of the protrusion from the base to a distal end of the protrusion.

In one or more embodiments, the article of footwear further comprises an upper. The medial arch portion and the lateral arch portion are secured to a medial side and to a lateral side of the upper, respectively. A forefoot region of the outsole has sidewall portions extending upward from the bottom portion and secured to the medial side and to the lateral side of the upper.

In an aspect of the present teachings, an article of footwear comprises an outsole that has a bottom portion with a peripheral edge, and has a medial arch portion. The bottom portion establishes a ground contact surface extending to the peripheral edge. The medial arch portion has a base extending upward from the peripheral edge of the bottom portion and a plurality of protrusions extending outward from the base.

In one or more embodiments, the plurality of protrusions are arranged in vertical alignments. In each one of the vertical alignments, at least one protrusion of the plurality of protrusions is closer to the bottom portion and has a larger effective diameter than at least one other protrusion of the plurality of protrusions that is further from the bottom portion.

In one or more embodiments, each of the plurality of protrusions is of the same shape.

In one or more embodiments, the bottom portion has a forefoot region, a midfoot region, and a heel region, and has tread elements in the forefoot region, the midfoot region, and the heel region. The peripheral edge may be free of the tread elements and of the plurality of protrusions. At least some of the tread elements of the bottom portion may be of an identical shape as at least some of the plurality of protrusions.

In one or more embodiments, the medial arch portion has a rear edge, a front edge, and an apex between the rear edge and the front edge. The rear edge angles forward from the bottom portion to the apex, and the front edge angles rearward from the bottom portion to the apex.

In one or more embodiments, the article of footwear further comprises an upper. The medial arch portion is secured to a medial side of the upper. A forefoot region of the outsole has a sidewall portion extending upward from the bottom portion and secured to the medial side of the upper.

"A," "an," "the," "at least one," and "one or more" are used interchangeably to indicate that at least one of the item is present; a plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items.

Those having ordinary skill in the art will recognize that terms such as "above," "below," "upward," "downward," "top," "bottom," etc., are used descriptively relative to the figures, and do not represent limitations on the scope of the invention, as defined by the claims.

The above features and advantages and other features and advantages of the present disclosure are readily apparent from the following detailed description of modes for carrying out the concepts of the disclosure when taken in connection with the accompanying drawings.

Figure 2:
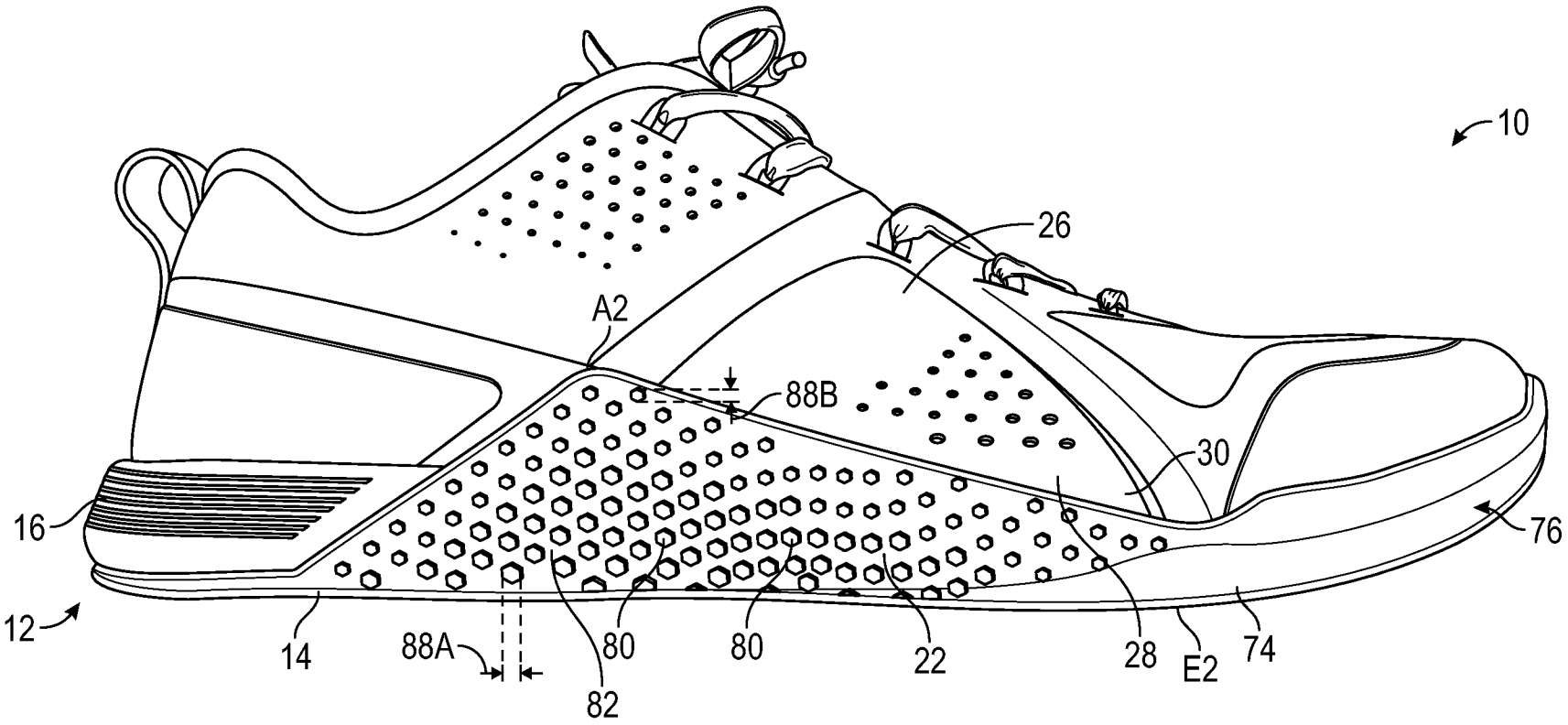
FIG. 2 is a schematic illustration in side view of a lateral side of the article of footwear of FIG. 1.
Figure 3:
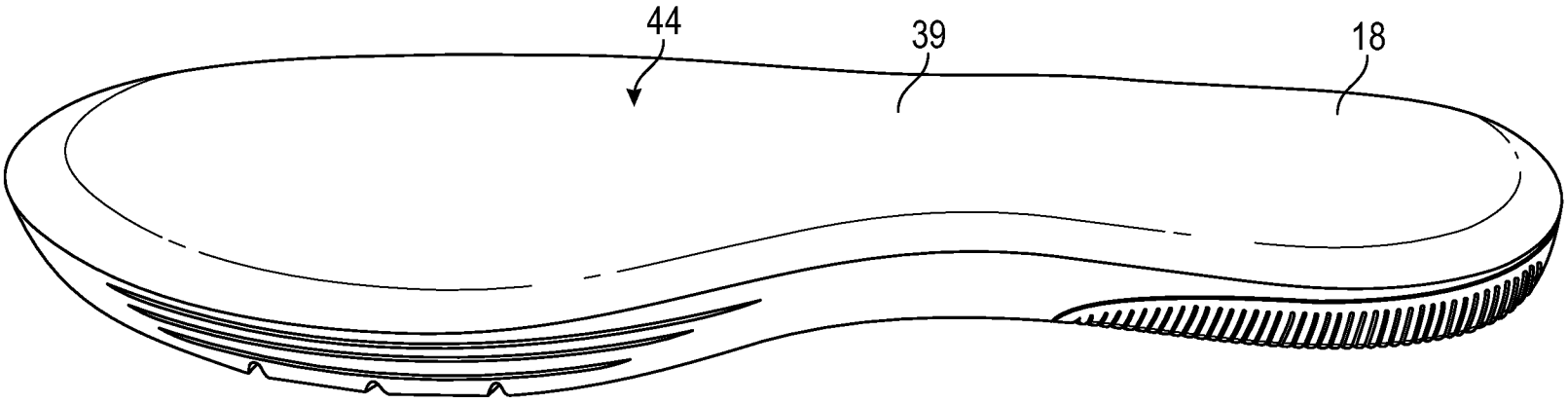
FIG. 3 is a schematic illustration in perspective view of an inner midsole layer of the article of footwear of FIG. 1.

Referring to the drawings, wherein like reference numbers refer to like components throughout the several views, FIG. 1 is a medial side view of an article of footwear 10 that includes a sole assembly 12 with an outsole 14, an outer midsole layer 16, and an inner midsole layer 18 (shown in FIG. 3). As further disclosed herein, the inner midsole layer 18 is not adhered or otherwise secured to any component of the article of footwear 10, thereby preventing undesirable rigidity. The inner midsole layer 18 is not as hard as the outer midsole layer 16 to enhance cushioning for running or other activities, while at the same time the outer midsole layer 16 and the outsole 14 provide stability for activities such as weightlifting. Moreover, the outsole 14 includes medial and lateral arch portions 20, 22 shown in FIGS. 1 and 2 that extend upward along and are secured to a medial side 24 of a footwear upper 26 and to a lateral side 28 of the upper 26 at a perimeter 30 of the upper 26 to provide traction for activities such as rope climbing.

As used herein, a lateral side of a component for an article of footwear, such as a lateral side 28 of the upper 26, is a side that corresponds with the side of the foot of the wearer of the article of footwear 10 that is generally further from the other foot of the wearer (i.e., the side closer to the fifth toe of the wearer). The fifth toe is commonly referred to as the little toe. A medial side of a component for an article of footwear, such as a medial side 24 of the article of footwear 10, is the side that corresponds with an inside area of the foot of the wearer and is generally closer to the other foot of the wearer (i.e., the side closer to the hallux of the foot of the wearer). The hallux is commonly referred to as the big toe. The lateral side 28 and the medial side 24 both extend from the foremost extent 32 of the upper 26 to the rearmost extent 34 of the upper 26.

Figure 9:
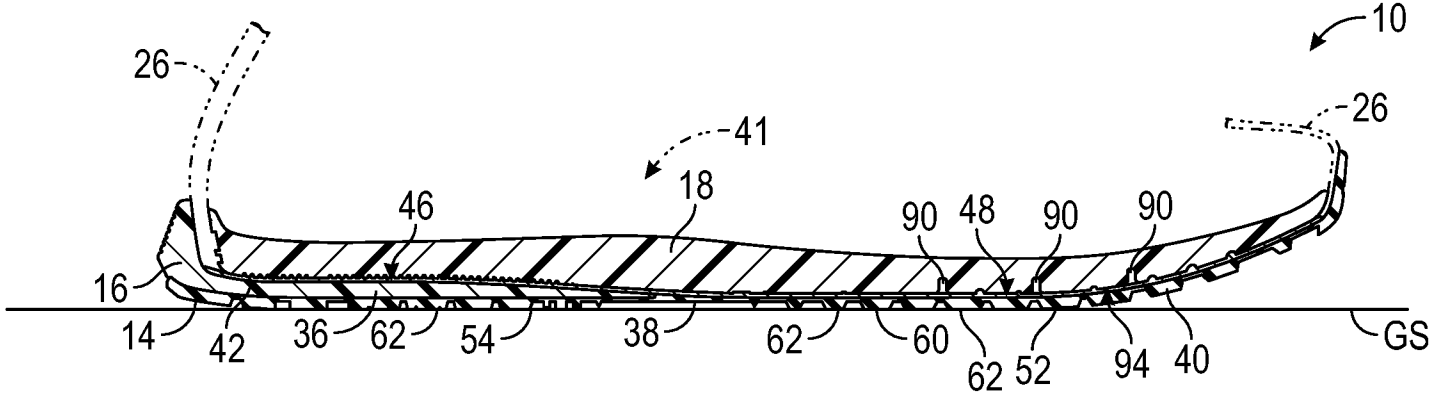
FIG. 9 is a schematic cross-sectional illustration of the sole assembly of FIG. 4 taken at lines 9-9, and showing a strobel unit and the footwear upper in fragmentary phantom view.
Figure 10:
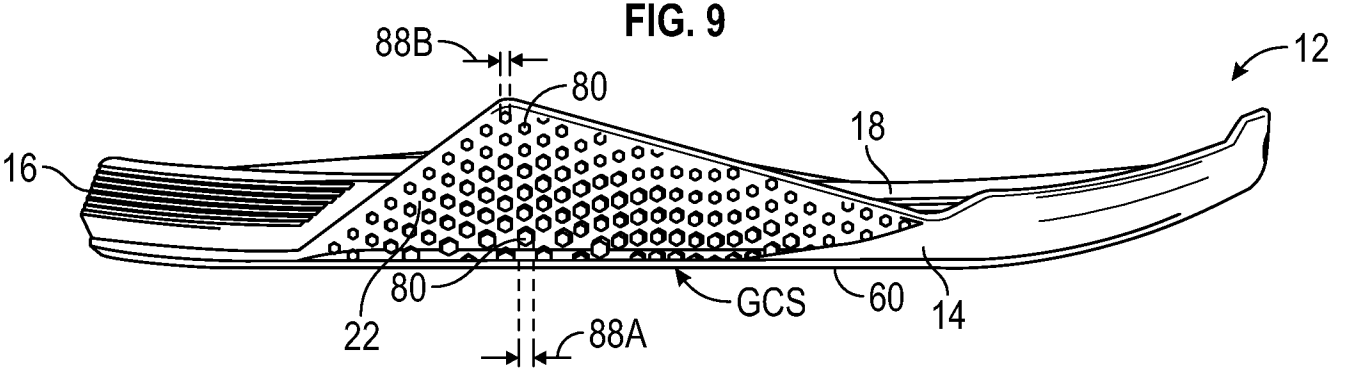
FIG. 10 is a schematic illustration in side view of the lateral side of the sole assembly of FIG. 4.
Figure 11:
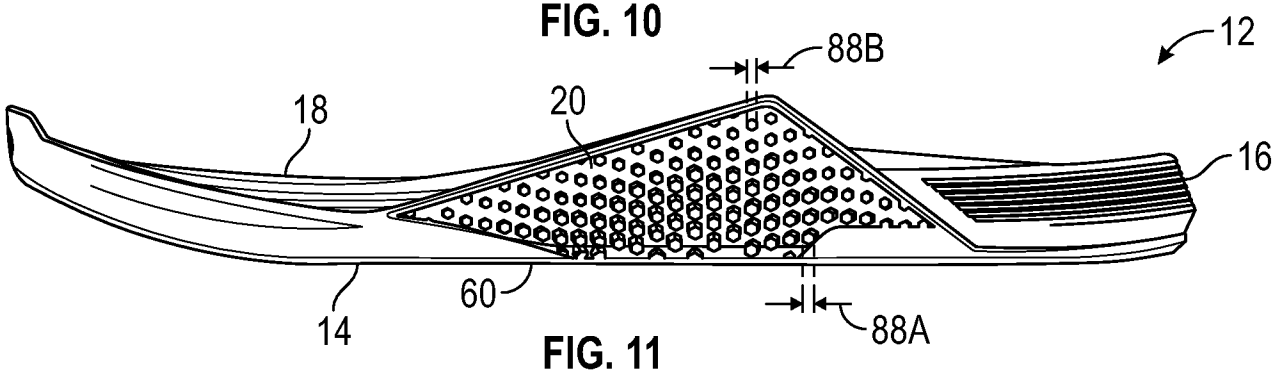
FIG. 11 is a schematic illustration in side view of the medial side of the sole assembly of FIG. 4.
Figure 12:
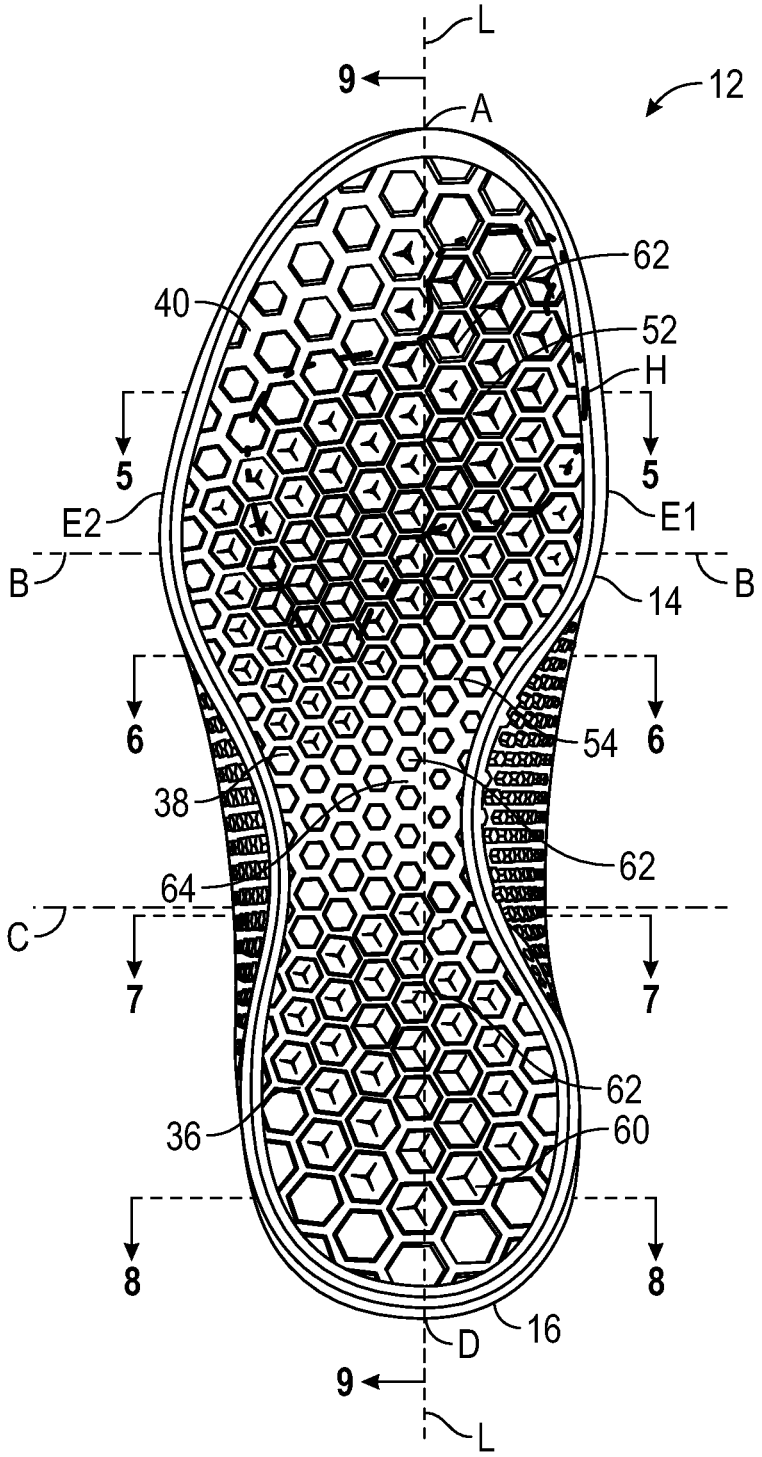
FIG. 12 is a schematic illustration in bottom view of the sole assembly of FIG. 4 and showing a phantom line separating portions of the outsole having different hardnesses.

As best shown in FIGS. 1, 9, and 12, the outsole 14 has a heel region 36, a midfoot region 38, and a forefoot region 40. The midfoot region 38 is between the heel region 36 and the forefoot region 40. For purposes of discussion, the heel region 36, the midfoot region 38, and the forefoot region 40 are respectively defined as the rearmost third, the middle third, and the foremost third of the outsole 14. Accordingly, the forefoot region 40 extends from a foremost extent A of the outsole 14 to lateral marker B, which is spaced one-third of the way from the foremost extent A to the rearmost extent D of the outsole 14 along a longitudinal axis L. The midfoot region 38 extends from lateral marker B to lateral marker C, which is spaced two-thirds of the way from the foremost extent A to the rearmost extent D along the longitudinal axis L. The heel region extends from the lateral marker C to the rearmost extent D.

The heel region 36 generally includes portions of the outsole 14 corresponding with rear portions of a human foot including the calcaneus bone and of a size corresponding with the outsole 14 and article of footwear 10. Forefoot region 40 generally includes portions of the outsole 14 corresponding with the toes and the joints connecting the metatarsals with the phalanges of the human foot of the size corresponding with the outsole 14 and article of footwear 10. Midfoot region 38 generally includes portions of the outsole 14 corresponding with an arch area of the human foot of the size corresponding with the outsole 14 and article of footwear 10.

FIG. 9 shows that the outer midsole layer 16 is secured to the outsole 14 and extends only over the heel region 36 and a portion of the midfoot region 38. The inner midsole layer 18 is supported by the outer midsole layer 16 and the outsole 14 but is not fixed thereto. In other words, the inner midsole layer 18 is not adhered, sewn, bonded, welded, or otherwise secured to any other component of the article of footwear 10. Instead, the inner midsole layer 18 simply rests on a strobel unit 42 within a cavity 41 defined and bounded by the upper 26 and the strobel unit 42. The strobel unit 42 is stitched to the upper 26. Alternatively, heat seaming, bonding, or other methods of securing the footwear upper 26 to the strobel unit 42 can be used. The strobel unit 42 is also adhered or bonded directly to an upward-facing surface 46 of the outer midsole layer 16 at the heel region 36, to a portion of the midfoot region 38 not covered by the outer midsole layer 16, and directly to an upward-facing surface 48 of the outsole 14 at the forefoot region 40. The upper 26 can be comprised of multiple separate pieces and materials such as fabric, textiles, leather, plastics, etc. With reference to FIG. 1, in the embodiment shown, the upper 26 includes a relatively stiff polymer heel counter 27, a leather portion 29, a fabric mesh portion 31, a polymer toe cap 33, a cloth lining 35, and a nylon pull strap 37.

Figure 4:
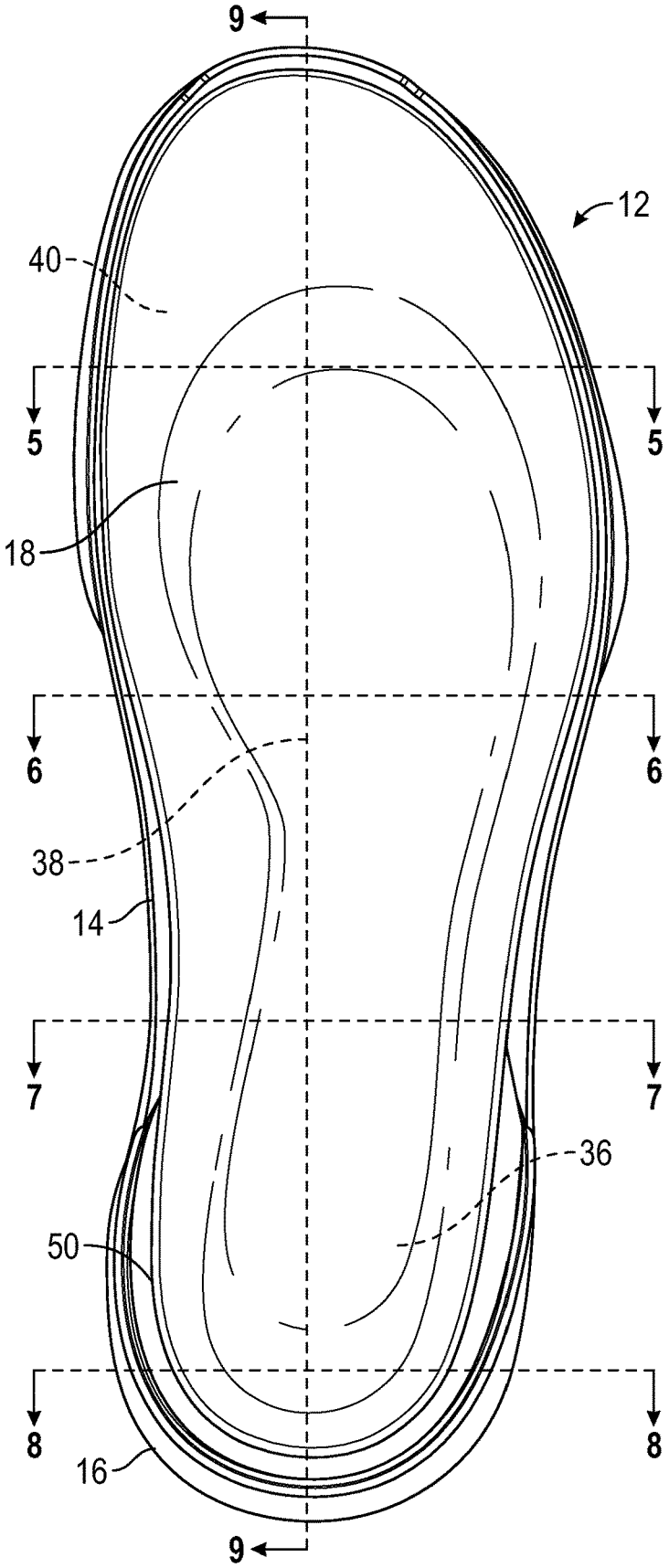
FIG. 4 is a schematic illustration in plan view of a sole assembly of the article of footwear of FIG. 1 with a footwear upper not shown.
Figure 8:
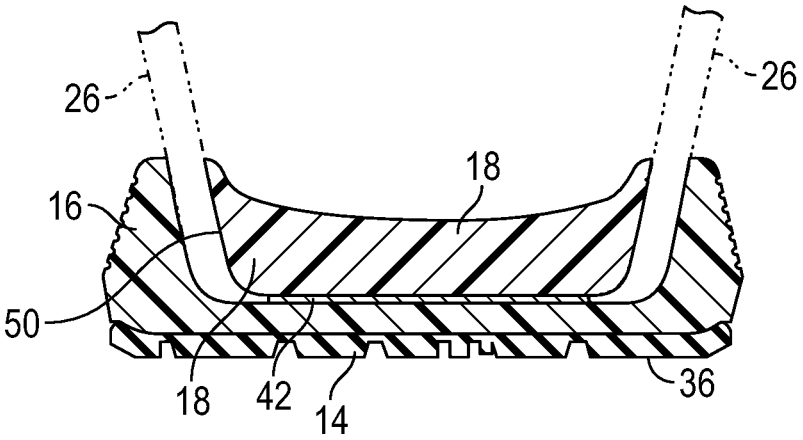
FIG. 8 is a schematic cross-sectional illustration of the sole assembly of FIG. 4 taken at lines 8-8, and showing a strobel unit and the footwear upper in fragmentary phantom view.

As shown in FIGS. 3 and 9, the inner midsole layer 18 is a full-length midsole layer, such that it extends over the heel region 36, the midfoot region 38, and the forefoot region 40 when placed in the cavity 41. The inner midsole-layer 18 can thus be selectively inserted or removed from the cavity 41, and is referred to as a drop-in midsole. Because the inner midsole layer 18 is not secured to any component of the article of footwear 10, it may exhibit some minimal relative movement with respect to the strobel unit 42, the outer midsole layer 16 and the outsole 14 under some load forces. This reduces rigidity, and produces a flexible feel during wear. However, the inner midsole layer 18 is supported by outer midsole layer 16 and the outsole 14, and is relatively confined by the outer midsole layer 16 and the upper 26. For example, as best shown in FIGS. 4 and 8, the outer midsole layer 16 is configured to surround a periphery 50 of the inner midsole layer 18 at the heel region 36.

As further discussed herein, the outer midsole layer 16 is harder than the inner midsole layer 18. For example, in one embodiment, the outer midsole layer 16 is seven points harder than the inner midsole layer 18 when hardness is measured on a Durometer Shore A scale. Both the inner midsole layer 18 and the outer midsole layer 16 can be a polymeric foam, such as ethylene vinyl acetate (EVA) foam. The inner midsole layer 18 can be a lighter weight, less dense foam than the outer midsole layer 16. The inner midsole layer 18 is configured with a substantially uniform hardness that provides appropriate cushioning and compliance under the heel of a wearer, while the surrounding outer midsole layer 16 is harder to provide lateral support, resiliency, and energy absorption at the heel region 36. As shown in FIG. 3, the inner midsole layer 18 has a fabric liner 39 secured to a foot-receiving surface 44, i.e., an upper surface.

The outsole 14, on the other hand, is not of a uniform hardness. Specifically, FIG. 12 shows a boundary H that generally separates first portion 52 of the outsole from a second portion 54 of the outsole 14. The first portion 52 extends over only some of the forefoot region 40 and coincides generally with a pressure-bearing region under the ball of a wearer's foot. The second portion 54 includes an entire remainder of the outsole 14. The first portion 52 has a first hardness, and the second portion 54 has a second hardness greater than the first hardness. The first portion 52 is softer than the second portion 54, and has a greater coefficient of friction with respect to a ground surface GS, shown in FIG. 9, than does the harder rubber of the second portion 54. The first portion 52 is thus both more compliant and provides greater traction with respect to forces conveyed from the ball of a wearer's foot through the forefoot region 40, such as during lateral movement and/or climbing. The outsole 14 may be a thermoplastic rubber or other durable material. The material for the outsole 14 may be selected to provide a desirable combination of durability and flexibility.

Figure 13:
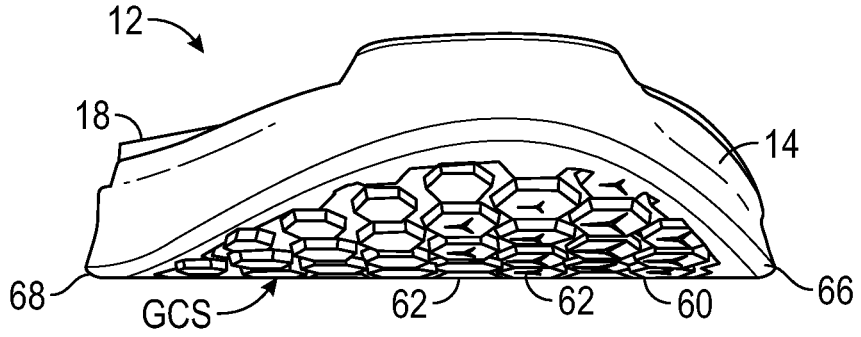
FIG. 13 is a schematic illustration in front view of the sole assembly of FIG. 4.
Figure 14:
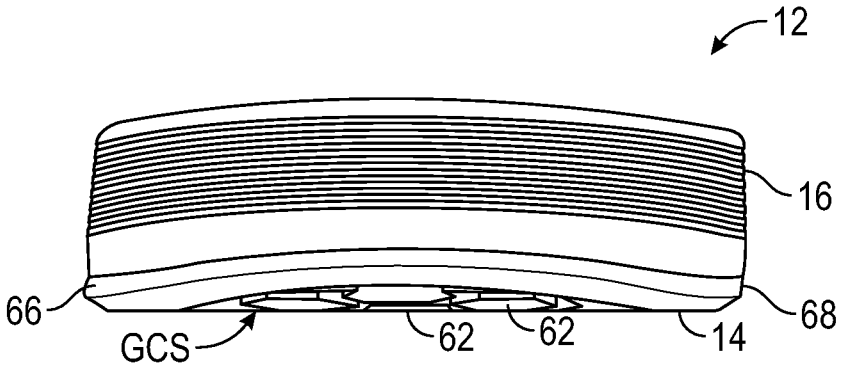
FIG. 14 is a schematic illustration in rear view of the sole assembly of FIG. 4.

With reference to FIGS. 9-12, the outsole 14 has a bottom portion 60 that defines a ground contact surface GCS. The ground contact surface GCS includes those portions of the bottom portion 60 that are configured to be in contact with the ground surface GS of FIG. 9 when the article of footwear 10 is worn for most activities in which the wearer is generally upright, such as running or weightlifting. As is evident in FIGS. 9 and 12, the bottom portion 60 has a plurality of molded tread elements 62 of various sizes, most or all of which have a hexagonal shape. Other shapes of tread elements may be used within the scope of the present disclosure. The tread elements 62 extend outward from a base 64 of the outsole 14. Accordingly, those ones of the tread elements 62 in contact with the ground surface GS establish the ground contact surface GS. As is shown in FIGS. 10, 11, 13, and 14, the tread elements 62 are configured so that the ground contact surface GCS of the outsole 14 is generally flat from a medial side 66 of the outsole 14 to a lateral side 68 of the outsole 14 when the article of footwear 10 is placed upright as shown and is not being worn, i.e., when the outsole 14 is unloaded, or when the outsole 14 is bearing the weight of a person wearing the article of footwear 10 and standing upright. As indicated in FIGS. 9, 13 and 14, not all of the tread elements 62 are likely to be in contact with the ground contact surface GCS at once, and different portions of the outsole 14 will be in contact with the ground as the wearer's foot moves relative to the ground.

Figure 5:
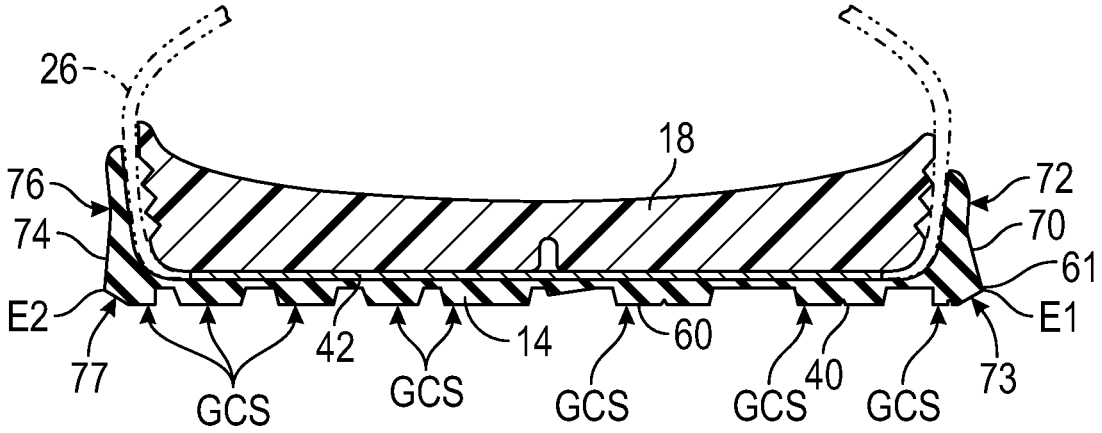
FIG. 5 is a schematic cross-sectional illustration of the sole assembly of FIG. 4 taken at lines 5-5, and showing a footwear upper in fragmentary phantom view.
Figure 6:
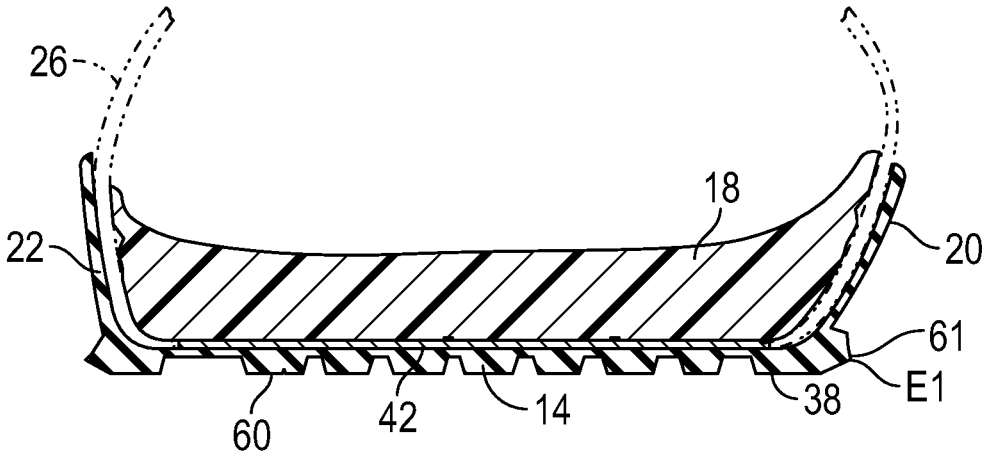
FIG. 6 is a schematic cross-sectional illustration of the sole assembly of FIG. 4 taken at lines 6-6, and showing a footwear upper in fragmentary phantom view.

The substantial flatness of the ground contact surface GCS from the medial side 66 to the lateral side 68 at any given location along the longitudinal axis L of the outsole 14 contributes to the stability of the article of footwear 10. Specifically, the article of footwear 10 is relatively difficult to roll laterally given the substantial width and flatness of the bottom portion 60. Additionally, as shown in FIG. 5, the outsole 14 has a medial sidewall portion 70 with a first side surface 72 that extends substantially perpendicularly to the bottom ground contact surface GCS. The outsole 14 also has a lateral sidewall portion 74 with a second side surface 76 that extends substantially perpendicularly to the bottom contact surface GCS. The medial sidewall portion 70 and the lateral sidewall portion 74 are adjacent the forefoot region 40 of the outsole 14. A peripheral edge E1 is defined by and is a corner 61 between the bottom portion 60 and the medial side wall portion 70 at an angled surface 73, similar to a chamfer. A peripheral edge E2 is defined by and between the bottom portion 60 and the lateral sidewall portion 74 at an angled surface 77, similar to a chamfer, as also shown in FIG. 12. The peripheral edge E1 extends between and is further defined by the medial arch portion 20 and the bottom portion 60 as indicated in FIGS. 1 and 6. The peripheral edge E1 is the corner 61 of the outsole 14 between the bottom portion 60 and the medial arch portion 20. The medial arch portion 20 has a rear edge RE, a front edge FE, and an apex A1 between the rear edge RE and the front edge FE. The rear edge RE angles forward from a rearmost extent 82A of the rear edge RE to the apex A1. The front edge FE angles rearward from a foremost extent 82B of the front edge FE to the apex A1. The corner 61 extends between the bottom portion 60 and the medial arch portion 20 from the rearmost extent 82A of the rear edge RE to the foremost extent 82B of the front edge FE, as best shown in FIG. 1. By providing angled surfaces 73, 77 with edges E1, E2 rather than a more rounded transition from the bottom portion 60 to the sidewall portions 70, 74, the stability and resistance to lateral roll of the outsole 14 is increased.

FIGS. 1, 2, 6-7, 10-12 show the medial arch portion 20 extending from the bottom portion 60 on the medial side 24 of the bottom portion 60, and the lateral arch portion 22 extending from the bottom portion 60 on a lateral side 28 of the bottom portion 60. The medial arch portion 20 and lateral arch portion 22 are generally triangular in shape, and extend approximately half-way up the sides of the upper 26 to an apex A1, A2, respectively.

Figure 7:
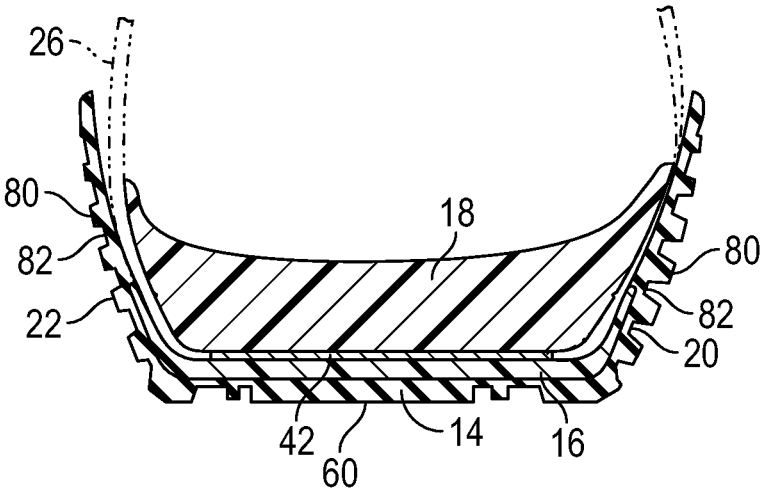
FIG. 7 is a schematic cross-sectional illustration of the sole assembly of FIG. 4 taken at lines 7-7, and showing a strobel unit and the footwear upper in fragmentary phantom view.
Figure 20:
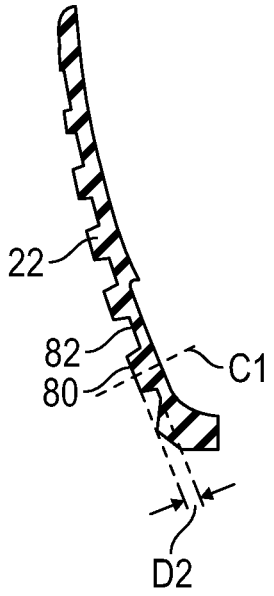
FIG. 20 is a schematic illustration in fragmentary cross-sectional view of the lateral arch portion of the outsole.
Figure 21:
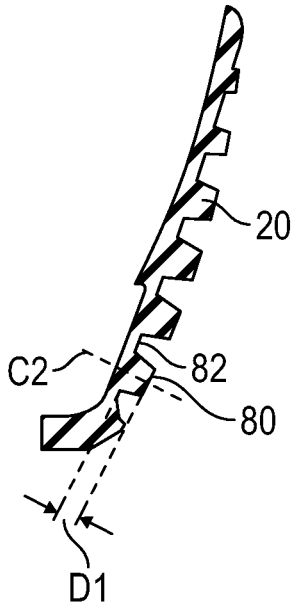
FIG. 21 is a schematic illustration in fragmentary cross-sectional view of the medial arch portion of the outsole.

A plurality of spaced protrusions 80 extend outward from a base 82 of the outsole 14 at the medial arch portion 20 and at the lateral arch portion 22, as shown in FIGS. 1 and 2. Like the tread elements 62, the protrusions 80 are hexagonal in shape, but other shapes may be used. In fact, the protrusions 80 serve as tread elements for the medial arch portion 20 and the lateral arch portion 22, such as when the article of footwear 10 is used for rope climbing. During rope climbing, the medial arch portion 20 is generally pressed against a rope and used for traction during ascent. During descent, the climber may reposition his foot so that the lateral arch portion 22 is in contact with the rope. Generally, greater traction is desired when ascending, than when descending. During descent, a skilled rope climber may desire contact between the rope and the lateral arch portion 22, but may wish to use the lateral arch portion 22 for sliding support against the rope to increase the speed of descent. Accordingly, a greater coefficient of friction is desired at the medial arch portion 20 than at the lateral arch portion 22. To accommodate these needs, the spaced protrusions 80 extend further outward from the base 82 on the medial arch portion 20 than on the lateral arch portion 22. FIG. 21 shows the lateral and medial arch portions of FIG. 7 in larger view. FIGS. 7 and 20 show that the longest spaced protrusions 80 on the medial arch portion 20 extend a distance D1 from the base 82, while FIG. 20 shows that the longest spaced protrusions 80 on the lateral arch portion 22 extend a lesser distance D2 from the base 82. The distances D1, D2 outward from the base 82 are measured along a respective center axis C1, C2 of the protrusion 80.

It is also apparent in FIGS. 1, 2, and 7 that the spaced protrusions 80 on either of the medial arch portion 20 or the lateral arch portion 22 extend further outward near the bottom portion 60, and decrease in outward extension in a direction further away from the bottom portion 60 (i.e., protrusions 80 closer to the apex A1 or A2 extend outward less than those protrusions 80 closer to the bottom portion 60). In addition to decreasing in length of extension, the spaced protrusions 80 also decrease in effective diameter in a direction away from the bottom portion 60. In other words, protrusions 80 closer to the apex A1 or A2 have a smaller effective diameter than those protrusions 80 closer to the bottom portion 60. FIGS. 1 and 2 show a protrusion close to the bottom portion 60 having an effective diameter 88A, while a protrusion closer to the apex A1 or A2 has a smaller effective diameter 88B. As used herein, the effective diameter of the hexagonal protrusion 80 is the diameter of a circular protrusion having an equivalent surface area as the hexagonal face of the protrusion.

Figure 15:
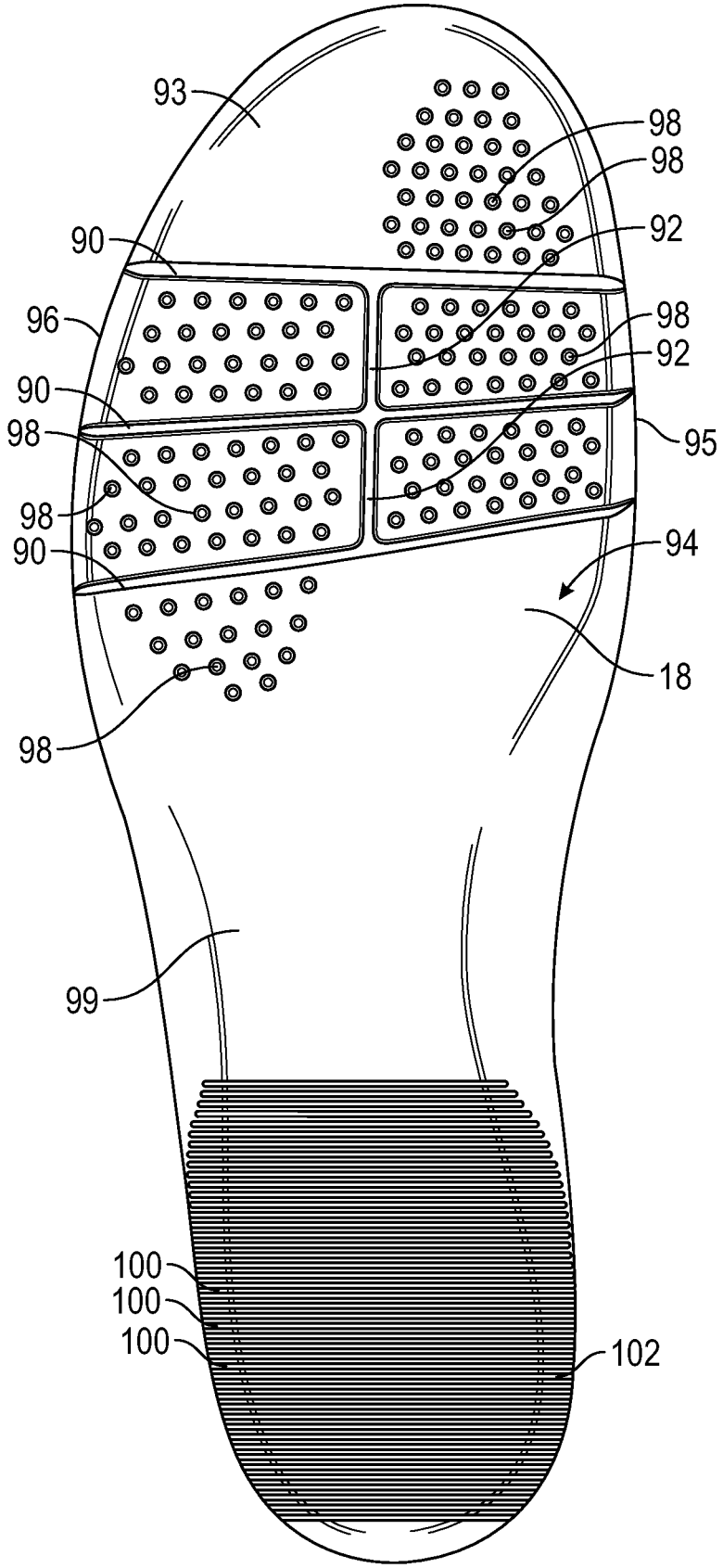
FIG. 15 is a schematic illustration in bottom view of an inner midsole layer of the sole assembly of FIG. 4.
Figure 16:
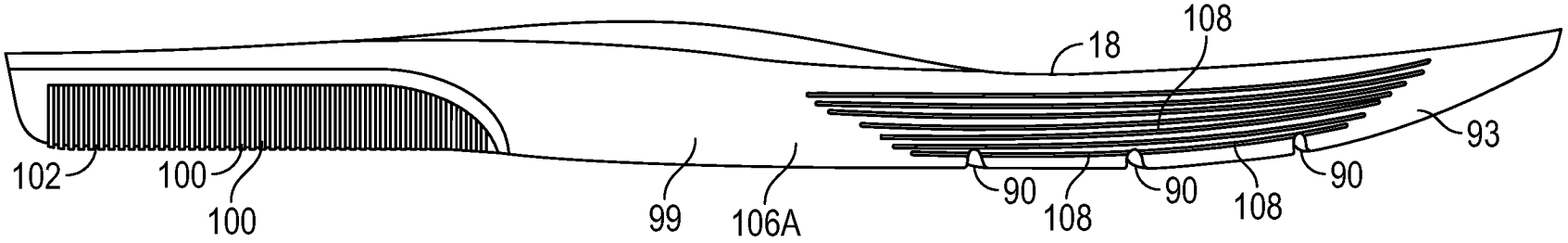
FIG. 16 is a schematic illustration in side view of a lateral side of the inner midsole layer of FIG. 15.

With reference to FIG. 15, the inner midsole layer 18 is formed with grooves 90, 92 in a forefoot portion 93 of the inner midsole layer 18. The grooves 90, 92 extend over the forefoot region 40 of the outsole 14 when the inner midsole layer 18 is placed in the cavity 41 of the article of footwear 10. The grooves 90, 92 are in a bottom surface 94 of the inner midsole layer 18 that contacts the strobel unit 42 in the forefoot region 40. The grooves 90 are transverse grooves as they extend transversely from a medial side 95 to a lateral side 96 of the inner midsole layer 18. Groove 92 is a longitudinal groove as it extends longitudinally and intersects at least some of the transverse grooves 92. The grooves 90, 92 increase compliance and flexibility of the inner midsole layer 18 in the forefoot region 40.

FIG. 15 also shows that the bottom surface 94 of the inner midsole layer 18 that contacts the strobel unit 42 has spaced recesses 98, only some of which are labeled with reference numbers. The spaced recesses 98 are in the bottom surface 94 of the inner midsole layer 18 that contacts the strobel unit 42 in the forefoot region 40, and therefore extend over the forefoot region 40 of the outsole 14 when the inner midsole layer 18 is placed in the cavity 41. The spaced recesses 98 increase compliance of the material of the inner midsole layer 18 in the forefoot region 40. Additionally, the spaced recesses 98 increase the coefficient of friction of the inner midsole layer 18 on the strobel unit 42 relative to a relatively smooth midfoot portion 99 of the inner midsole layer 18. The increased coefficient of friction in the forefoot region 93 helps to limit sliding movement of the inner midsole layer 18 relative to the strobel unit 42. The pattern of the spaced recesses 98 in FIG. 15 generally coincides with the first portion 52 of the outsole 14 (shown in FIG. 12) that has softer rubber than the second portion 54. The grooves 90, 92, spaced recesses 98, and first portion 52 thus all align in the forefoot region 40 to increase compliance, flexibility, and cushioning in the forefoot region 40 of the article of footwear 10.

FIG. 15 shows that the inner midsole layer 18 also has transverse grooves 100 in a heel portion 102 of the inner midsole layer 18. The grooves 100 are generally shallower than the grooves 90. The grooves 100 help to increase the compliance and coefficient of friction of the inner midsole layer 18 in the heel region 102 relative to a relatively smooth midfoot portion 99 of the inner midsole layer 18. The increased coefficient of friction in the heel region 102 helps to limit sliding movement of the inner midsole layer 18 relative to the strobel unit 42 when the inner midsole layer 18 is placed in the cavity 41.

Figure 17:
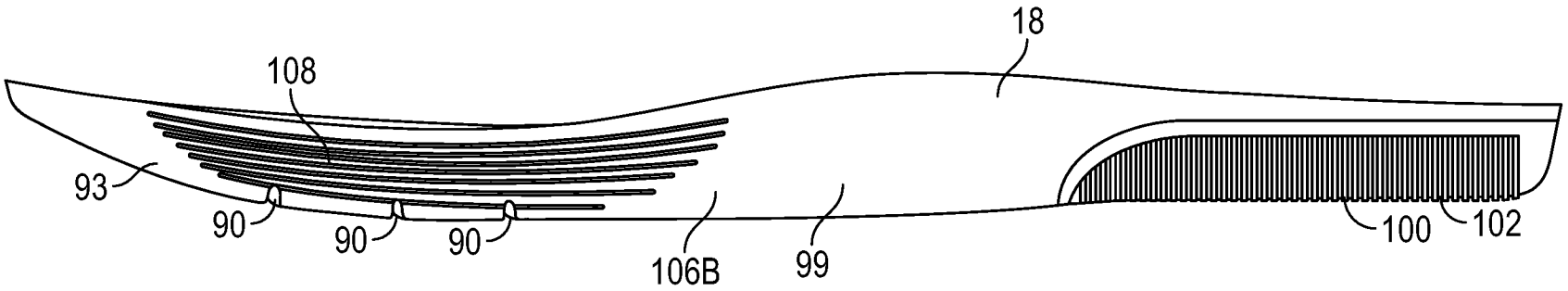
FIG. 17 is a schematic illustration in side view of a medial side of the inner midsole layer of FIG. 15.
Figure 18:
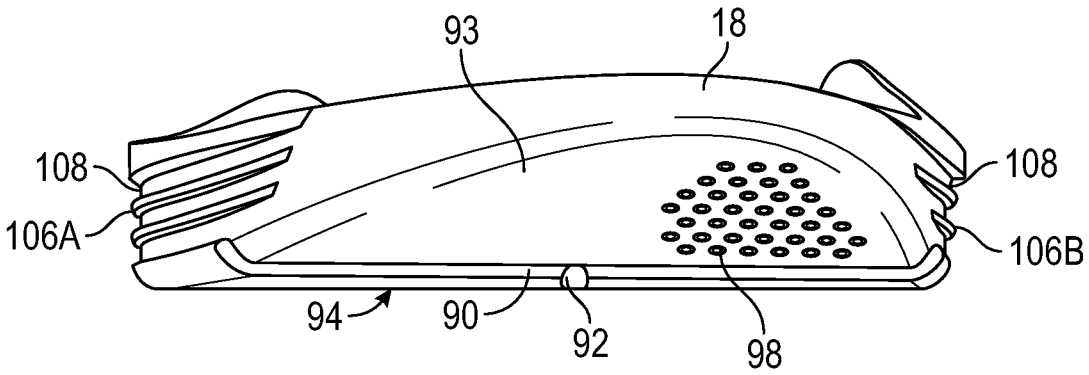
FIG. 18 is a schematic illustration in front view of the inner midsole layer of FIG. 15.
Figure 19:
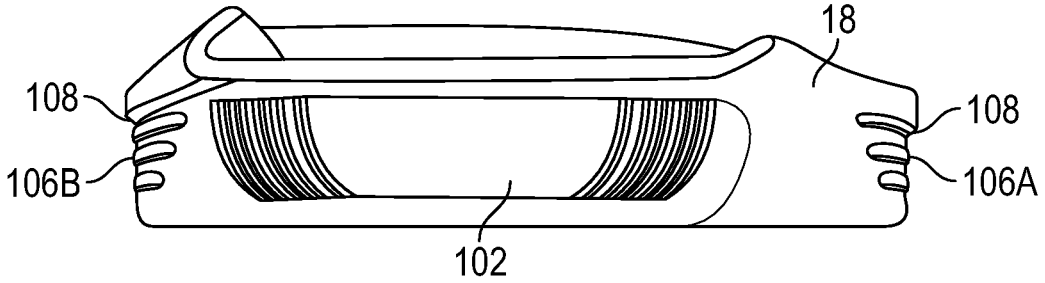
FIG. 19 is a schematic illustration in rear view of the inner midsole layer of FIG. 15.

FIGS. 16-19 show that the inner midsole layer 18 has lateral and medial sidewall portions 106A, 106B both of which have longitudinally extending pleats 108 generally in the forefoot portion 93 and extending partway into the midfoot portion 99 as indicated in FIG. 17. The pleats 108 may also be referred to alternating ridges and valleys. The pleats 108 increase compliance of the forefoot portion 93 of the inner midsole layer 18. It is apparent in FIGS. 16 and 17 that the grooves 100 of the heel portion 102 continue from the bottom surface 94 of the inner midsole layer 18 to the sidewall portions 106A, 106B.

While several modes for carrying out the many aspects of the present teachings have been described in detail, those familiar with the art to which these teachings relate will recognize various alternative aspects for practicing the present teachings that are within the scope of the appended claims.

The invention claimed is:

1. An article of footwear comprising:

an outsole that has a bottom portion and a medial arch portion extending upward from a peripheral edge of the bottom portion, the bottom portion and the medial arch portion angled relative to one another such that the peripheral edge is a corner between the bottom portion and the medial arch portion;

wherein the medial arch portion has a rear edge, a front edge, and an apex between the rear edge and the front edge, the rear edge angles forward from a rearmost extent of the rear edge to the apex, and the front edge angles rearward from a foremost extent of the front edge to the apex;

wherein the corner extends between the bottom portion and the medial arch portion from the rearmost extent of the rear edge to the foremost extent of the front edge;

wherein the medial arch portion of the outsole has a base and a plurality of protrusions extending outward from the base;

wherein the plurality of protrusions of the medial arch portion are arranged in vertical alignments;

wherein, in each one of the vertical alignments, at least one protrusion of the plurality of protrusions is closer to the bottom portion and has a larger effective diameter than at least one other protrusion of the plurality of protrusions that is further from the bottom portion;

wherein the outsole further comprises a lateral arch portion extending upward from the bottom portion;

wherein the lateral arch portion has a base and a plurality of protrusions extending outward from the base; and wherein at least one of the plurality of protrusions extending outward from the base of the medial arch portion has a greater length than at least one of the plurality of protrusions extending outward from the base of the lateral arch portion, with length of a protrusion measured along a center axis of the protrusion from the base to a distal end of the protrusion.

2. The article of footwear of claim 1, wherein, in each one of the vertical alignments, a first protrusion of the plurality of protrusions has a greater length than a second protrusion of the plurality of protrusions, the second protrusion further from the bottom portion than the first protrusion.

3. The article of footwear of claim 1, wherein, in each one of the vertical alignments, the protrusions increase in effective diameter in a direction toward the bottom portion.

4. The article of footwear of claim 1, wherein each of the plurality of protrusions is of the same shape.

5. The article of footwear of claim 1, wherein the medial arch portion is triangular.

6. The article of footwear of claim 1, wherein the article of footwear has a forefoot region, a midfoot region, and a heel region, and the bottom portion has tread elements in the forefoot region, in the midfoot region, and in the heel region.

7. The article of footwear of claim 6, wherein at least some of the tread elements of the bottom portion and at least some of the protrusions are of an identical shape.

8. The article of footwear of claim 1, further comprising:

an upper;

wherein the medial arch portion and the lateral arch portion are secured to a medial side and to a lateral side of the upper, respectively; and wherein a forefoot region of the outsole has sidewall portions extending upward from the bottom portion and secured to the medial side and to the lateral side of the upper.

9. The article of footwear of claim 1, wherein the outsole further comprises an angled surface at the corner between the bottom portion and the medial arch portion.

10. An article of footwear comprising:

an upper;

an outsole that has a bottom portion with a peripheral edge, and has a medial arch portion;

wherein the bottom portion establishes a ground contact surface extending to the peripheral edge;

wherein the medial arch portion has a base extending upward from the peripheral edge, the base angled relative to the bottom portion at the peripheral edge such that the peripheral edge is a corner of the outsole;

wherein the medial arch portion has a rear edge, a front edge, and an apex between the rear edge and the front edge, the rear edge angles forward from a rearmost extent of the rear edge to the apex, and the front edge angles rearward from a foremost extent of the front edge to the apex;

wherein the corner extends between the bottom portion and the medial arch portion from the rearmost extent of the rear edge to the foremost extent of the front edge;

wherein the medial arch portion has a plurality of protrusions extending outward from the base;

wherein the outsole further comprises a lateral arch portion extending upward from the bottom portion;

wherein the medial arch portion and the lateral arch portion are secured to a medial side and to a lateral side of the upper, respectively;

wherein a forefoot region of the outsole has sidewall portions extending upward from the bottom portion and secured to the medial side and to the lateral side of the upper;

wherein the bottom portion has the forefoot region, a midfoot region, and a heel region, and has tread elements in the forefoot region, the midfoot region, and the heel region; and wherein the peripheral edge is free of the tread elements and of the plurality of protrusions.

11. The article of footwear of claim 10, wherein the protrusions are arranged in vertical alignments; and wherein, in each one of the vertical alignments, at least one protrusion of the plurality of protrusions is closer to the bottom portion and has a larger effective diameter than at least one other protrusion of the plurality of protrusions that is further from the bottom portion.

12. The article of footwear of claim 11, wherein each of the plurality of protrusions is of the same shape.

13. The article of footwear of claim 10, wherein at least some of the tread elements of the bottom portion are of an identical shape as at least some of the plurality of protrusions.

14. The article of footwear of claim 10, wherein the outsole further comprises an angled surface at the corner between the bottom portion and the medial arch portion.

* * * * *